US005177883A

United States Patent [19]

Darby

[11] Patent Number: 5,177,883

[45] Date of Patent: Jan. 12, 1993

[54] ADJUSTABLE HEIGHT SHOE FOR LEG LENGTHENING PROCEDURES AND LEG LENGTH DISCREPANCIES

[75] Inventor: H. Darrel Darby, Huntington, W. Va.

[73] Assignee: Darco International Inc., Huntington, W. Va.

[21] Appl. No.: 887,380

[22] Filed: May 21, 1992

Related U.S. Application Data

[63] Continuation of Ser. No. 534,608, Jun. 7, 1990, abandoned.

[51] Int. Cl.[5] ..... A43B 3/26; A43B 13/00

[52] U.S. Cl. ..... 36/97; 36/103; 36/132; 36/140

[58] Field of Search ..... 36/1, 83, 97, 101, 103, 36/132, 140, 155, 159, 178, 181

[56] References Cited

U.S. PATENT DOCUMENTS

| | | | |
|---|---|---|---|
| 2,509,423 | 5/1950 | Cramer | 36/97 |
| 2,545,910 | 3/1951 | Aprile | 36/132 |
| 3,061,951 | 11/1962 | Barron | 36/1 |
| 4,425,721 | 1/1984 | Spronken | 36/110 |
| 4,800,657 | 1/1989 | Brown | 128/581 |

FOREIGN PATENT DOCUMENTS

| | | | |
|---|---|---|---|
| 0219403 | 6/1942 | Switzerland | 128/581 |
| 2159038 | 11/1985 | United Kingdom | 36/101 |
| 2178940 | 2/1987 | United Kingdom | 36/101 |

*Primary Examiner*—Paul T. Sewell
*Assistant Examiner*—Marle Denise Patterson
*Attorney, Agent, or Firm*—Sughrue, Mion, Zinn, Macpeak & Seas

[57] ABSTRACT

An adjustable height shoe for leg lengthening procedures to correct for leg length discrepancy has a removable outer sole which is coupled to a midsole of a shoe upper with a number of unequal, graduated thickness interlocking connecting filler soles interposed therebetween. A removable heel pad provides a heel lift of one-half of the thickness of the thinnest filler sole. Gradual reduction in the vertical height of the stack of filler soles and the outer sole in conjunction with inclusion or exclusion of the heel pad is correlated to the increase in leg length of the wearer. Opposing, abutting faces of filler soles or of filler soles with the outer sole and midsole are interlocked by correspondingly sized, configured height projections and recesses such as circular pegs and circular holes for the abutting members. Straps passing through aligned vertical slots within the outer sole and the midsole maintain the filler soles as part of a stacked assembly.

12 Claims, 1 Drawing Sheet

ADJUSTABLE HEIGHT SHOE FOR LEG LENGTHENING PROCEDURES AND LEG LENGTH DISCREPANCIES

This is a Continuation of application Ser. No. 07/534,608 filed Jun. 7, 1990.

FIELD OF THE INVENTION

This invention relates to a height adjustable shoe, and more particularly to such shoe designed with a removable outer sole assembly of stacked, different thickness components, added and removed to suit the patient's need as leg length changes in response to leg lengthening medical procedures, and to match length discrepancies between these user's right and left legs.

BACKGROUND OF THE INVENTION

In the 1950's Professor G. A. Ilizarov developed a revolutionary method in the orthopaedic field for lengthening a leg to narrow or eliminate leg length discrepancies between the legs of human patients. Millions of patients have successfully had a shortened leg gradually lengthened in increments by Ilizarov method. The Ilizarov system is an exceptionally versatile circular external fixator which attaches to bone by tensioned small diameter wires with a few different types of components combined in hundreds of different configurations to allow compression, distraction, angulation, rotation and translation of bone segments. The Ilizarov method is used in the treatment of open and closed fractures, pseudoarthrosis or non-unions of long bones, limb lengthening, bone and soft tissue deformities and segmental bone and soft tissue defects.

Fortunately, the apparatus is highly stable, permitting weight bearing and joint function during treatment.

For reconstructive orthopaedic problems, the Ilizarov apparatus is used in combination with a surgical technique known as corticotomy. A percutaneous ostomy is performed preserving periosteal and endosteal tissues and blood vessels. The corticotomy site is gradually distracted, forming "regenerate" new bone in the distraction gap resulting in essentially reconstruction of a damaged leg and lengthening of the same, in many cases to the same length as the normal leg of the patient.

In the initial placement of the circular external fixator to the patient's leg, the open framed cylindrical apparatus is attached to the limb by means of strong thin wires which are placed through the bone and attached under high tension rings at opposite axial ends of the fixator. Corticotomy is performed through a small incision, the hard outer cortex of the bone is cut while preserving periosteal and endosteal blood supply within the interior of the bone. After surgery, the fixator remains attached and the patient makes adjustments. Following surgery the patient turns specific knobs or nuts daily at predescribed intervals to separate the cut bone ends and trigger the regeneration of bone, nerves, blood vessels and soft tissue. The average rate of regeneration is approximately one millimeter per day.

It is therefore a primary object of the present invention to provide an adjustable height shoe to be worn by a patient during orthopaedic surgery and post surgery treatment under the Ilizarov method or similar method and utilizing the Ilizarov system or similar method, and wherein the height of the shoe is periodically, incrementally adjusted to match the incremental periodic lengthening of the leg correlated to adjustments made within the Ilizarov system for increasing the distance between the points of the external fixators attached to the bone by the tension small diameter wires.

DESCRIPTION OF THE PREFERRED EMBODIMENT

Figure 1:
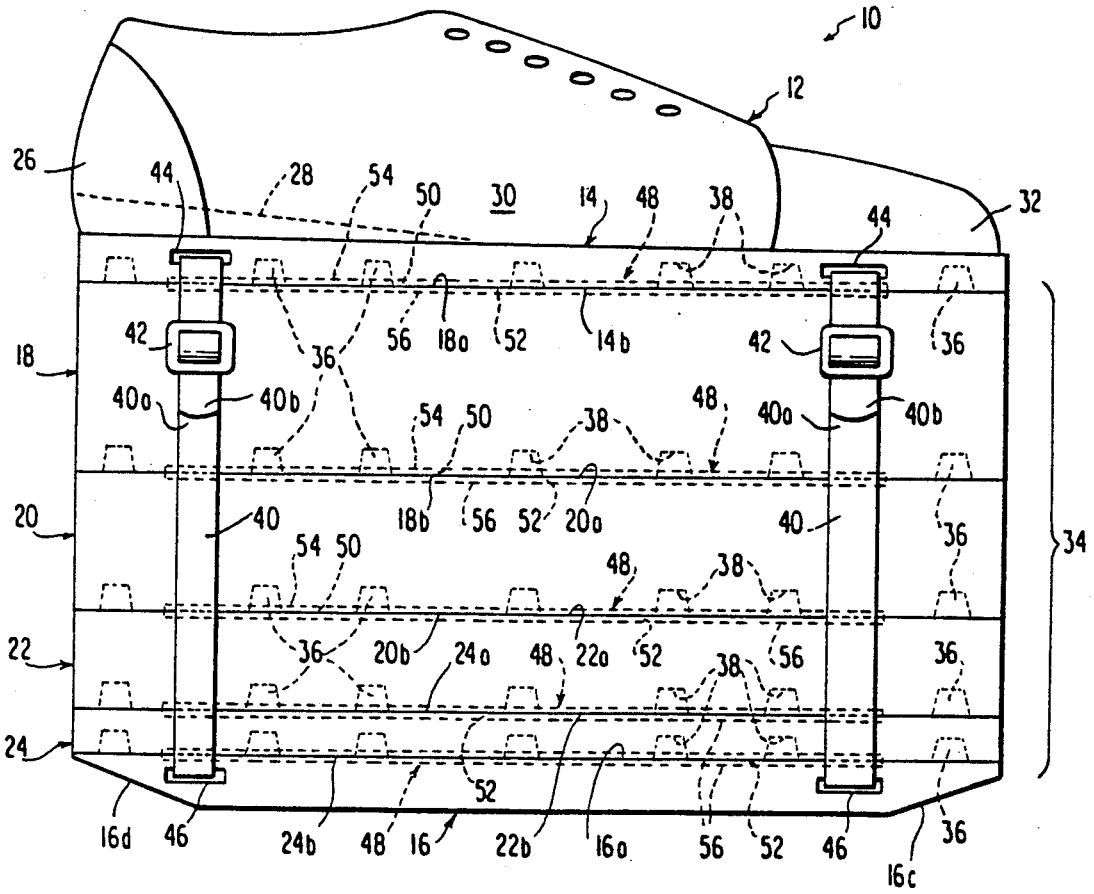
FIG. 1 is a side elevational view of an adjustable height shoe for leg lengthening procedures and leg length discrepancies forming a preferred embodiment of the invention.

Referring to the drawings, the adjustable height shoe forming a preferred embodiment of the invention is indicated generally at 10, and consists of a standard shoe upper indicated generally at 12 to which is sewed, adhesively fixed or thermally bonded or otherwise a flat, planar midsole 14. A removable, flat outer sole 16 which is of generally the same thickness as the midsole 14 is adapted for removable fitting to the midsole 14 of the shoe (and indeed would be so coupled for a second shoe fitting the normal length foot of a patient) using a pair of such adjustable height shoes 12. The upper 12 of the shoe 10 is a standard construction of leather and/or synthetic material, and may be manufactured in standard sizes.

The primary aspect of the invention lies in the utilization of a plurality of interconnecting filler soles 18, 20, 22 and 24 in the illustrated embodiment, which are the same dimensions and configuration as the outer sole 16, with the exception of thickness or vertical height, which varies. The interconnecting filler soles 18, 20, 22 and 24 may preferably be formed of a light weight material such as EVA or similar synthetic material, and are available in the following thickness or vertical height for each sized shoe: a filler sole 18 which is of a thickness of 4 cm, a filler sole 20 which is 3 cm in thickness, a filler sole 22 which is 2 cm thick, and a filler sole 24 of a thickness of 1 cm . Each filler sole is of uniform thickness of the complete length of the filler sole. Further, the thinnest filler sole 24 is of a given thickness X equal to 1 cm in the illustrated embodiment, and the other filler soles of the stack of filler soles are of proportionally increased thicknesses 2X, 3X, 4X for filler soles 22, 20 and 18, respectively. In addition, a tapered, ½ cm heel pad is used, and it is removably fitted in the bottom of the inside heel 26 of the shoe 10, the heel pad being illustrated in dotted form, FIG. 1 at 28. The heel pad 28 extends through the arch 30 of the shoe. The heel pad is of a length from ⅓ to ½ the full length of the shoe from the shoe heel 26 to the shoe tip 32.

It is necessary to maintain a stacked array 34 comprised of filler soles such as 18, 20, 22 and 24 and the outer sole 16, in order from the midsole 14 in proper fore and aft and side to side alignment, and of course coupled to the midsole 14 and its integral upper 12, so that the patient is rendered ambulatory after surgery and throughout the post surgery treatment with the circular external fixator of the Ilizarov system in place. Further the shoe 10 permits the number of filler soles employed and their relationship to the heel pad 28 to be varied to match the height of the stacked sole assembly 34 to the shorter leg after the patient makes each periodic adjustment to increase the overall length of the leg under treatment in average rate increments of 1 mm per day.

Fore and aft and side to side orientation of midsole 14, filler soles 18, 20, 22 and 24 and the outer sole 16 is effected in the illustrated embodiment by interlocking means between the respective soles. Specifically a combination of interlocking pegs projecting from one face of a sole received within the holes of the face of the abutting sole. Starting with the outer sole 16, the top faces 16*a*, 24*a*, 22*a*, 20*a* and 18*a* of the outer sole 16, the filler soles 24, 22, 20 and 18 respectively, are provided with a series of longitudinally spaced vertically upright circular pegs 36 which may be molded into these soles. In the illustrated embodiment, ten such frustoconical pegs 36 project upwardly from the upper faces of the respective soles 16, 18, 20, 22 and 24 at laterally offset positions with respect to the longitudinal center line of the soles. To effect the interfitting engagement, the midsole 14 and filler soles 18, 20, 22 and 24 are provided with a series of slightly larger sized frustoconical holes 38 which are formed within the bottom faces 14*b*, 18*b*, 20*b*, 22*b* and 24*b* respectively of midsole 14, and filler soles 18, 20, 22 and 24 in that order. The holes 38 are of like number, longitudinally spaced and aligned with and laterally offset from the longitudinal center line of the soles so as to be coaxial with respective pegs 36 on the top faces of the four filler soles 18, 20, 22 and 24 and the outer sole 16 and receiving said pegs.

In order to maintain the stacked assembly 34 coupled to the shoe upper via the midsole 14 (permanently attached to the shoe upper 12), a pair of straps 40 are employed. The straps 40 have buckles 42 on one end 40*a* nd have opposite free ends 40*b* fed through the buckle 42 after forming a complete loop through vertically aligned horizontal slot 44 within tip portion of the midsole 14 and slot 46 within the tip portion of outer sole 16, and vertically aligned slots 44 and 46 within heel portions of the midsole and outer sole 16, respectively, and cinched down tight.

Preferably, opposite type hook-and-loop interengaging material strips are embedded into the bottom face 14*b* of the midsole, both top and bottom faces of the filler soles 18, 20, 22 and 24 and the top face 16*a* of outer sole 16 at common longitudinally spaced position extending transversely across the majority of the lateral face of the sole faces to detachably couple the soles, in addition to maintaining the interlocking connecting filler soles together and in engagement with the midsole at the top and the outer sole 16 at the bottom of those stacked filler soles. Such opposite type hook-and-loop material strips are commercially sold under the registered trademark VELCRO. Specifically, as shown in FIG. 2, over the heel area and that of the ball of the foot, elongated rectangular shallow recesses 56 are provided, and hook-type material strips 52 adhesively fixed to the upper face 18*a* of 4 cm filler sole 18. As evidenced in dotted line showings in FIG. 1, like recesses 54 are provided positions of a length equal to the recesses 56, FIG. 2, within the upper face 18*a* of the filler sole 18, within the bottom face 14*b* of midsole 14, which carry loop-type engaging material strips 50 whose loops face toward and are engageable by hooks of matching strips 52. The recesses 54 are of a lateral width equal to that of recess 56 in FIG. 2, and the interengaging releasable strips 50 and 52 forming intrlocking assemblies 48 are of identical plan configuration and size, and of course sized to fit within the respective recesses 54, 56 of midsole 14, filler soles 18, 20, 22 and 24 and outer soles 16 at their facing surfaces 14*b*, 18*a*; 18*b*, 20*a*; 20*b*, 22*a*; 22*b*, 24*a*; and 24*b*, 16*a*. The presence of the VELCRO ® different type engageable loop-and-hook material strips 50, 52 render the stacked assembly 34 more stable, facilitate the clinching up of straps 40 and, after the straps 40 are removed, maintains the integrity of the stack 34, but permits the ready removal of a given filler sole and a replacement of another in the stack, in the manner described in detail hereinafter.

To permit the patient wearing the adjustable height shoe 10 on a given foot utilizing the full stacked assembly 34, and to walk in a near normal manner, the tip end of the outer sole is beveled at 16*c*, upwardly and forwardly from the outer sole bottom face 16*b*, and in the reverse upwardly oblique position at the heel end of that outer sole as at 16*d*.

The adjustable height shoe 10 is utilized during patient treatment by decreasing the thickness of the sole assembly 34 approximately 5 mm (½ cm at each adjustment) thereby providing a near level leg length and allowing for normal gait throughout the leg lengthening procedure. As an example, a patient with a right leg shortening of 10.5 cm is fitted with the shoe 10 in the manner illustrated in FIG. 1. The left shoe on the uninvolved leg would be devoid of filler soles, and the interlocking outer sole 16 would be glued and locked permanently to midsole 14 of the left shoe upper 12.

Figure 2:
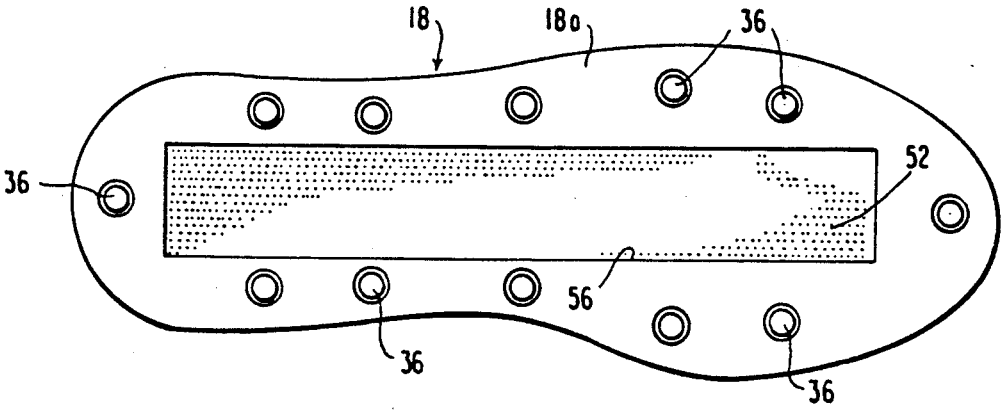
FIG. 2 is a top plan view of one of the filler soles partially forming a stacked sole assembly of the adjustable height shoe of FIG. 1.

The right shoe would have the stack of outer sole and filler soles in accordance with the showing of FIG. 1, plus the ½ cm heel pad 28 inside the shoe 10 to make the right leg equal to the left. The sole height of the right shoe, FIG. 1, would be reduced ½ cm approximately every five days until all the interlocking filler soles 18, 20, 22 and 24 and the heel pad 28 were removed form the right shoe, at which point the structure of the left and right shoes would be identical. At that time the right leg length would be fully corrected.

The procedure for modifying the stack assembly 34 to achieve that end while selectively inserting and removing the heel pad 20, is set forth in the following outline:

Step 1: After approximately five days the right leg will have lengthened 5 mm or ½ cm using the Ilizarov external fixation device, at which time the heel pad 28 is removed from the interior of the shoe upper 12.

Step 2: Remove the 1 cm filler 24, and return the ½ cm heel pad 28.

Step 3: Remove the heel pad 28.

Step 4: Remove the 2 cm filler sole 22, and return the 1 cm filler sole 24 to the stacked array 34, and reinsert the ½ cm heel pad 28 back into the shoe upper.

Step 5: Remove the heel pad 28.

Step 6: Remove the 1 cm filler sole 24 and add the heel pad 28.

Step 7: Remove the heel pad 28.

Step 8: Remove the 3 cm filler sole 20, add the 2 cm filler sole 22, and insert the ½ cm heel pad 28 back into the shoe upper.

Step 9: Remove the heel pad 28.

Step 10: Remove the 2 cm filler sole 22, and return the 1 cm filler sole 24 to the stacked array 34, and reinsert the ½ cm heel pad 28 back into the shoe upper.

Step 11: Remove the heel pad 28.

Step 12: Remove the 4 cm filler sole 18, add the 3 cm filler sole 20 to the stacked assembly 34, and insert the heel pad 28 into the shoe upper.

Step 13: Remove the heel pad 28 from the shoe upper 12.

Step 14: Remove the 3 cm filler sole 20, add the 2 cm filler sole 22, and insert the ½ cm heel pad 28 back into the shoe upper.

Step 15: Remove the heel pad 28.

Step 16: Remove the 2 cm filler sole 22, and return the 1 cm filler sole 24 to the stacked array 34, and reinsert the ½ cm heel pad 28 back into the shoe upper.

Step 17: Remove the heel pad 28.

Step 18: Remove the 1 cm filler 24 and add heel pad 28.

Step 19: Remove the heel pad 28.

Step 20: Return to normal footwear, i.e., normal identical pad and right shoes for the patient.

The use of the adjustable height shoes 10 and the process of varying the stacked assembly 34 of the shoe on the leg which is under surgical procedure for lengthening via the Ilizarov method is the same with greater or lesser leg discrepancies, and is accomplice by using the proper combination of interlocking filler soles and the heel pad 28 in the manner described above. The surgeon first determines the leg length discrepancy and the size of the shoes needed for the patient. In turn, the surgeon orders a pair of shoes and specifies right or left leg build-up. The surgeon receives the right and left shoes with the appropriate combustion of filler soles for the right or left shoe.

It should be appreciated that the materials for the components of the shoes are exemplary only, and various changes may be made to throe materials. Further, the pegs and holes forming the interfitting means may vary in number, configuration and location as desired or deemed necessary. Further, the number of straps and their location may be radially varied from that shown in the preferred embodiment.

While the invention has been particularly shown and described with reference to a preferred embodiment thereof, it will be understood by those skilled in the art that the foregoing and other changes in form and details may be made therein without departing from the spirit and scope of the invention.

What is claimed:

1. An adjustable height shoe for leg lengthening procedures to overcome leg length discrepancies comprising:

a midsole having top and bottom faces, a shoe upper fixedly coupled to the top face of said midsole and adapted to receive the foot of the leg requiring lengthening procedures, an outer sole of a length and configuration corresponding to that of the midsole and having a top face and a bottom face, said bottom face adapted to contact the ground, and a plurality of unequal, graduated thickness filler soles of a length and configuration corresponding to said midsole bottom face and said outer sole top face, each filler sole being of uniform thickness over the complete length thereof, wherein a thinnest filler sole is of a given thickness X, and the other filler soles are respectively of proportionally increased thicknesses 2X, 3X, etc., and means for detachably stacking said plurality of unequal, graduated thickness filler soles together, and coupling the stack of filler soles interposed between the bottom face of said midsole and the top face of the outer sole, such that by selectively varying the number of filler soles within the stack, the overall height of the shoe from the midsole to the outer sole may be incrementally reduced periodically to correspond to periodic increases in length of the leg subject to leg lengthening procedures.

2. The adjustable height shoe as claimed in claim 1, further comprising:

an insertable heel pad having a vertical height corresponding to half the thickness of the thinnest of said unequal graduated filler soles, such that by selective insertion and removal of the heel pad, along with selective inclusion and exclusion of the unequal, graduated thickness filler soles, the height of the adjustable height shoe may be changed in increments matching the vertical height of the heel pad insertably positioned within the shoe upper.

3. The adjustable height shoe as claimed in claim 1, fully comprises means for interlocking the outer sole to the bottom filler sole of the stack, all of the filler sloes together, and the top filler sole of the stack to the shoe midsole.

4. The adjustable height shoe as claimed in claim 3, wherein said filler soles have abutting top and bottom faces within said stack, said bottom filler sole has a bottom face abutting the top face of the outer sole, said top filler sole has a top face abutting the bottom face of the midsole, and wherein between given pairs of abutting faces one face includes at least one vertical projection and the other of said abutting faces includes at least one recess of corresponding size, configuration and location receiving said at least one projection, thereby constituting said interlocking means.

5. The adjustable height shoe as claimed in claim 4, wherein said at least one projection comprise a plurality of circular pegs and said at least one recess comprises a like plurally of circular holes of a diameter slightly larger than the diameter of said pegs, and wherein said circular holes are of a depth equal to the height of said pegs.

6. The adjustable height shoe as claimed in claim 5, wherein said shoe has a longitudinal center line, said pegs project outwardly of said one face and said circular holes within the other of said abutting faces are uniformly spaced over the length of abutting soles, and laterally offset of said longitudinally center line of the shoe over the full length of the shoe.

7. The adjustable height shoe as claimed in claim 1, wherein said means for stacking said plurality of filler soles intermediate of said midsole and said outer sole and detachably coupling said stack of filler soles and said outer soles to said midsoles comprises a plurality of straps passing over said filler soles and coupling said outer sole to said midsole.

8. The adjustable height shoe as claimed in claim 7, wherein said plurality of straps are constituted by a first strap looped vertically between and coupled to said outer sole and said midsole in proximity to the heel of said shoe, and a second strap looped vertically between and coupled to said midsole and said outer sole adjacent the tip of said shoe.

9. The adjustable height shoe as claimed in claim 7, wherein vertically aligned slots extend transversely through said midsole and said outer sole at longitudinally spaced positions, and said looped straps pass through respective vertically aligned slots within said midsole and outer sole.

10. The adjustable height shoe as claimed in claim 1, further comprising opposite, hook-and-loop type interengageable material strips fixedly mounted to opposed faces of said graduated thickness filler soles, said midsole and said outer sole and constituting in part said means for coupling said stack of filler soles interposed between the bottom face of the midsole and the top face of the outer sole.

11. The adjustable height shoe as claimed in claim 10, said opposite type interengaging hook-and-loop material strips comprise strips embedded into the faces of said midsole, filler soles and outer soles over heel and ball areas of said shoe.

12. The adjustable height shoe as claimed in claim 1, wherein said outer sole has front and rear bevelled ends at the tip and heel of said shoe to facilitate walking of a patient wearing said adjustable height shoe on the leg subject to said leg lengthening procedures.

* * * * *